US009153905B2

(12) United States Patent
Colson et al.

(10) Patent No.: US 9,153,905 B2
(45) Date of Patent: Oct. 6, 2015

(54) LOCKING DEVICE FOR A PLUG-AND-SOCKET CONNECTOR HOUSING

(75) Inventors: Wim Colson, Schepdal (BE); Henrik Stegmann, Stemwede (DE); Stefan Schnieder, Bohmte (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 10 days.

(21) Appl. No.: 14/235,171

(22) PCT Filed: Jun. 15, 2012

(86) PCT No.: PCT/DE2012/100179

§ 371 (c)(1),
(2), (4) Date: Apr. 4, 2014

(87) PCT Pub. No.: WO2013/013665

PCT Pub. Date: Jan. 31, 2013

(65) Prior Publication Data

US 2014/0235084 A1 Aug. 21, 2014

(30) Foreign Application Priority Data

Jul. 27, 2011 (DE) ..... 10 2011 052 192

(51) Int. Cl.

| | |
|---|---|
| ***H01R 4/50*** | (2006.01) |
| ***H01R 13/627*** | (2006.01) |
| ***H01R 13/639*** | (2006.01) |
| *H01R 13/52* | (2006.01) |

(52) U.S. Cl.

CPC ..... *H01R 13/6275* (2013.01); *H01R 13/6392* (2013.01); *H01R 13/5219* (2013.01)

(58) Field of Classification Search

CPC ..... H01R 13/6392; H01R 13/6275; H01R 13/5219; H01R 13/506; H01R 13/514; H01R 24/20; H01R 13/62; H01R 13/629; H01R 13/6395; H01R 13/639

USPC ..... 439/345

See application file for complete search history.

(56) References Cited

U.S. PATENT DOCUMENTS

| | | | |
|---|---|---|---|
| 3,163,481 | A | 12/1964 | Salvador |
| 3,332,051 | A | 7/1967 | Pippin, Jr. et al. |
| 5,658,162 | A | 8/1997 | Harting et al. |
| 6,152,644 | A | 11/2000 | Hein |

(Continued)

FOREIGN PATENT DOCUMENTS

| | | |
|---|---|---|
| DE | 1852077 | 3/1962 |
| DE | 19508605 | 7/1996 |
| DE | 19754528 | 6/1999 |

(Continued)

*Primary Examiner* — Jean F Duverne
(74) *Attorney, Agent, or Firm* — Jacobson Holman, PLLC.

(57) ABSTRACT

The invention relates to a locking apparatus for reversibly locking a plug-type connector housing (1) with a mating plug housing (2) provided for this purpose, wherein the locking apparatus (9, 9', 9") has at least one locking arm (15, 15', 15", 20, 20', 20"), wherein the at least one locking arm (15, 15', 15", 20, 20', 20") in turn comprises at least one receptacle (16, 16', 16", 17, 17', 17"), which interacts with bearing pins (18) integrally formed on the plug-type connector housing (1) and the mating plug housing (2) in such a way that the plug-type connector housing (1) and the mating plug housing are pressed against one another, wherein the at least one locking arm (15, 15', 15", 20, 20', 20") consists of an elastomeric material.

13 Claims, 3 Drawing Sheets

(56) References Cited

U.S. PATENT DOCUMENTS

Figure 1:
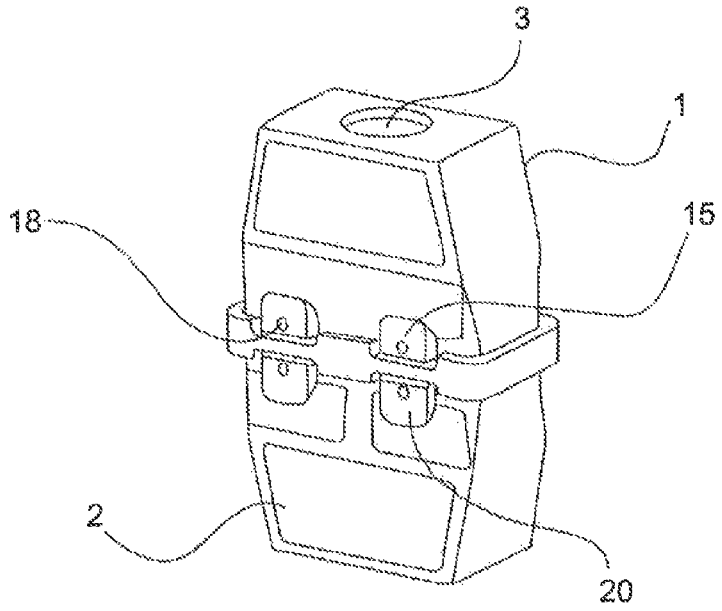

| | | | | |
|---|---|---|---|---|
| 7,811,117 | B2 * | 10/2010 | Andrade | 439/373 |
| 8,021,174 | B1 * | 9/2011 | Schutte | 439/144 |
| 8,134,074 | B2 * | 3/2012 | Ong et al. | 174/135 |
| 2013/0164997 | A1 | 6/2013 | Schmidt et al. | |

FOREIGN PATENT DOCUMENTS

| | | |
|---|---|---|
| DE | 20 2009 009707 | 9/2009 |
| GB | 911 713 | 11/1962 |
| GB | 2 257 572 | 1/1993 |
| WO | WO 2011/069521 | 6/2011 |

* cited by examiner

LOCKING DEVICE FOR A PLUG-AND-SOCKET CONNECTOR HOUSING

This is a national stage of PCT/DE12/100179 filed Jun. 15, 2012 and published in German, which has a priority of German no. 10 2011 052 192.5 filed Jul. 27, 2011, hereby incorporated by reference.

The invention relates to a locking device for the reversible locking of a plug-and-socket connector housing having a counter connector housing intended for this purpose according to the preamble of claim 1.

Plug-and-socket connector housings are generally equipped with a plurality of contact elements, which are connected for example with the individual conductors of a connected cable. The contact elements of the plug-and-socket connector housing are in contact with the contact elements of a matching counter connector. For this purpose, the contact elements have a pin- or socket-like design on the plug-in side. Locking devices are necessary to prevent the contacted contact elements of the plug-and-socket connector and the counter connector from being separated from each other by accident, for example by a light pull on the cable.

A plug-and-socket connector housing is disclosed in DE 195 08 605 C1, which comprises pivotably supported U-shaped locking straps on both sides. The locking straps comprise rocker arm-like locking elements, which are guided across pegs of a counter connector housing during the locking procedure. Said plug-and-socket connector housing lock is known under the trade name Han-easy-lock®.

A plug-and-socket connection secured by way of locking straps is considered highly reliable. However, if a plug-and-socket connector housing comprising these kinds of locking straps falls to the ground, the locking straps may become bent or the strap support damaged. As a result, the reliability of said type of lock is reduced. Moreover, the sealing effect between the plug-and-socket connector housings decreases.

A locking device for connecting two linked plug-and-socket connectors is disclosed in DE 197 54 528 A1. Pairs of locking arms each comprising insertion cut-outs are sticking out vertically from a basic shape. The plug-and-socket connectors each comprise pegs that cooperate with the insertion cut-outs of the locking device to create a reversible connection. Said type of locking device can likewise sustain considerable damage when dropped.

A connector that can be mounted reversibly in an electrical outlet by way of a rubber shackle is disclosed in DE1852077U. The rubber shackle has an oblong and flat shape and comprises two holes at the end, which each cooperate with pegs of the electrical outlet and the connector.

A plug-and-socket connector housing comprising two pushbuttons is disclosed in WO 2011069521 A1. The pushbuttons are connected with pieces of sheet steel on the inside of the housing, which comprise a recess that overlaps a snap-on extension of the respective matching counter connector housing. Said plug-and-socket connector including the lock is known on the market under the name Han-Yellock®.

Said type of lock is highly reliable and likewise protected against mechanical impacts (drops, hits, etc.). However, said type of lock is more expensive than a lock realized with locking straps.

The object of the invention is to propose a locking device for plug-and-socket connector housings linkable with each other, which is robust and at the same time economical.

The object is solved with the characterizing properties of claim 1.

The locking device according to the invention is intended for the reversible locking of a plug-and-socket connector housing having a matching counter connector. However, it is likewise conceivable that the locking device is used for locking a plug-and-socket connector housing of a machine bushing.

Hereinafter, a plug-and-socket connector housing and counter connector housing may also simply be referred to as housing. This is especially the case if the properties are equally transferable to both (plug-and-socket connector housing and counter connector housing).

Contact elements, which are each connected with the individual conductors of a connected cable, are arranged on the inside of the plug-and-socket connector housing. A plurality of individual contact elements are often combined in so-called plug-and-socket connector modules, such as they are disclosed for example in WO 2011069521 A1. The modules can subsequently be incorporated into the plug-and-socket connector housings as a whole.

The locking device comprises at least one pair of locking arms. The pair of locking arms consists of two individual locking arms, which stick out from the main body of the locking device in opposite directions. The individual locking arms comprise holders at the end. The supporting pegs formed on the respective plug-and-socket connector housings can engage in said holders such that the two plug-and-socket connector housings (connector and counter connector) are interlocked with each other. In this case, interlocked shall mean that the plug-and-socket connector housing and the counter connector housing are pushed against each other resiliently.

The resilient pushing against each other of two linked housings is preferably realized in that the locking arms of the locking device are stretchable in the axial direction. Therefore, the locking arms of the locking device are preferably made of an elastomeric material, for example nitrile butadiene rubber (NBR, HNBR), ethylene propylene diene monomer rubber (EPDM), polyurethane or a combination of the aforementioned materials.

Preferably, the elastomeric material is additionally fiber-reinforced to achieve a particularly long-lived locking device.

The linked plug-and-socket connector housings are generally sealed against the infiltration of media with a sealing element. In an advantageous embodiment of the invention, the sealing element is part of the locking device. The sealing element is essentially formed by the main body of the locking device and hence matches the design of the plug-and-socket connector housing. The at least one pair of locking arms sticks out from the main body, such that the sealing element and locking device are designed as a one-piece component.

The main body can also be referred to as locking ring. The locking ring can be clamped between the jointed seam of the plug-and-socket connector housing and the counter connector housing, thus sealing it.

In an advantageous embodiment of the invention, at least one locking arm is formed onto the sealing ring. Advantageously, a plurality of sealing arms is formed onto the sealing ring.

The elastomeric material, which the locking device is made of, advantageously has a Shore B hardness between 90 and 30. Yet, it may also be advantageous if the elastomeric material, which the locking device is made of, has a Shore A hardness between 90 and 30.

Tests have shown that a Shore A hardness between 60 and 70 is particularly advantageous. In this case, the locking arms can be removed again manually by the user from the support pegs of the plug-and-socket connector housings, without reducing the locking strength and tightness.

Normally, the holders of the locking arms will be bore holes, which are guided across the support pegs of the plug-and-socket connector housings. In an advantageous embodiment of the invention, the holders comprise a metal component by way of which said holders are reinforced. The metal component can for example be a lug that encompasses the edge of the holder of the locking arm. This renders the locking device according to the invention particularly durable and long-lived.

Instead of a metal component, the holders can also be reinforced with a plastic component. Said plastic reinforcement can be vulcanized or molded into the locking device directly during the manufacturing process.

In a particularly preferred embodiment of the invention, at least one locking arm of the locking device is mounted irreversibly on a plug-and-socket connector housing. This can be realized for example by way of a riveted connection. During the riveting procedure, the rivet is guided through the holders of the locking arm and at the same time through a matching bore hole in the housing. Next, the rivet head is irreversibly deformed by means of suitable tools. In this case, the locking device establishes a captive connection with a plug-and-socket connector housing.

Alternatively, an irreversible fastening of the locking device to a plug-and-socket connector housing can be achieved by way of adhesion. It is also conceivable that the locking device is vulcanized directly onto the plug-and-socket connector housing, especially if the housing is made of plastic.

In a particularly preferred embodiment of the invention, the locking device possesses only one locking arm formed onto the main body and sticking out of said main body in the opposite direction. The main body is fastened for example on a housing (for example by means of adhesion). The locking arm engages with the other housing, thus locking both housings with each other.

Advantageous embodiments of the invention are described in the sub-claims.

Figure 2:
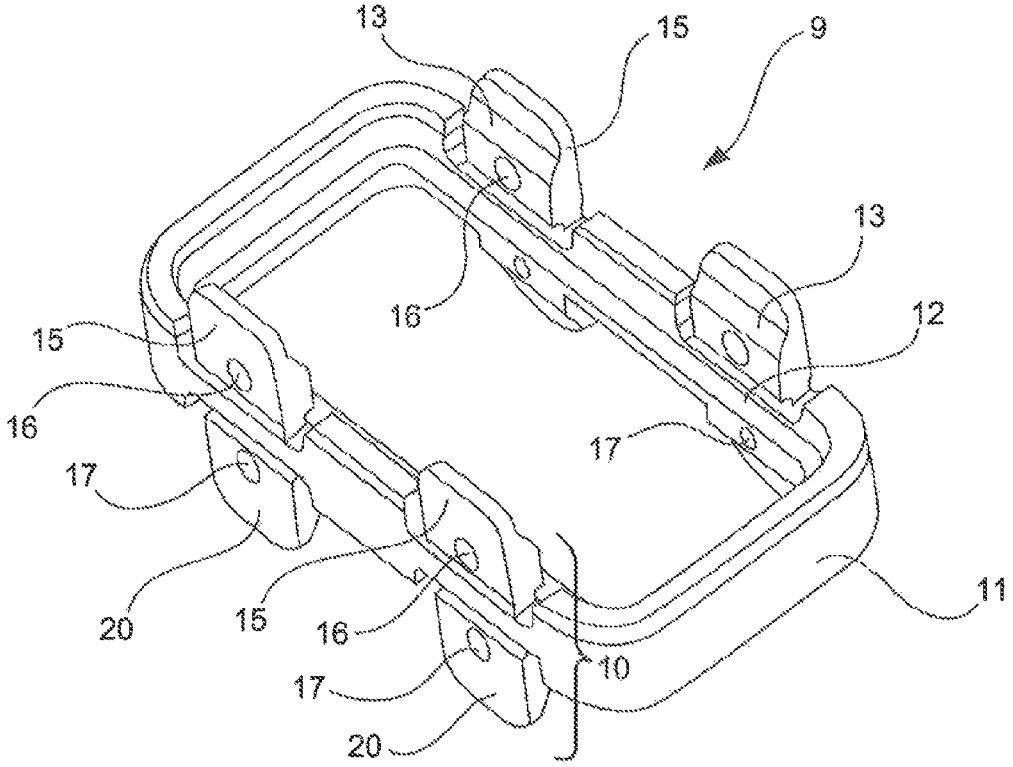
Figure 3:
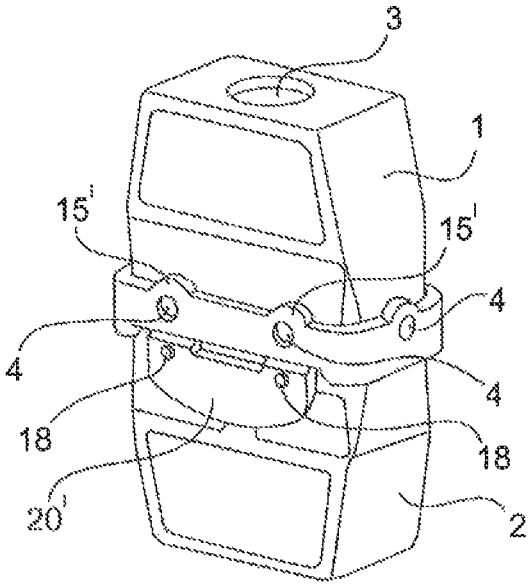
Figure 4:
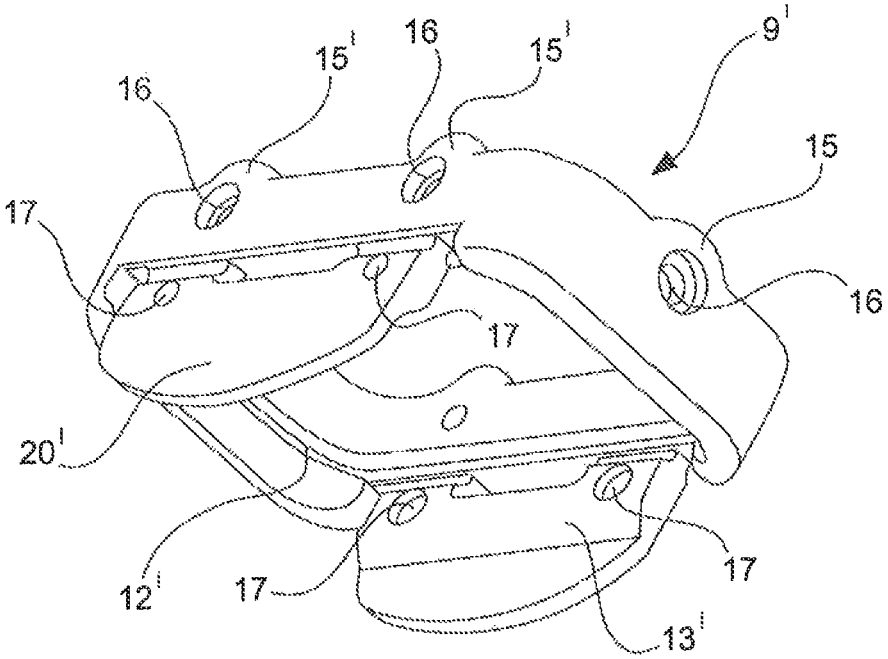
Figure 5:
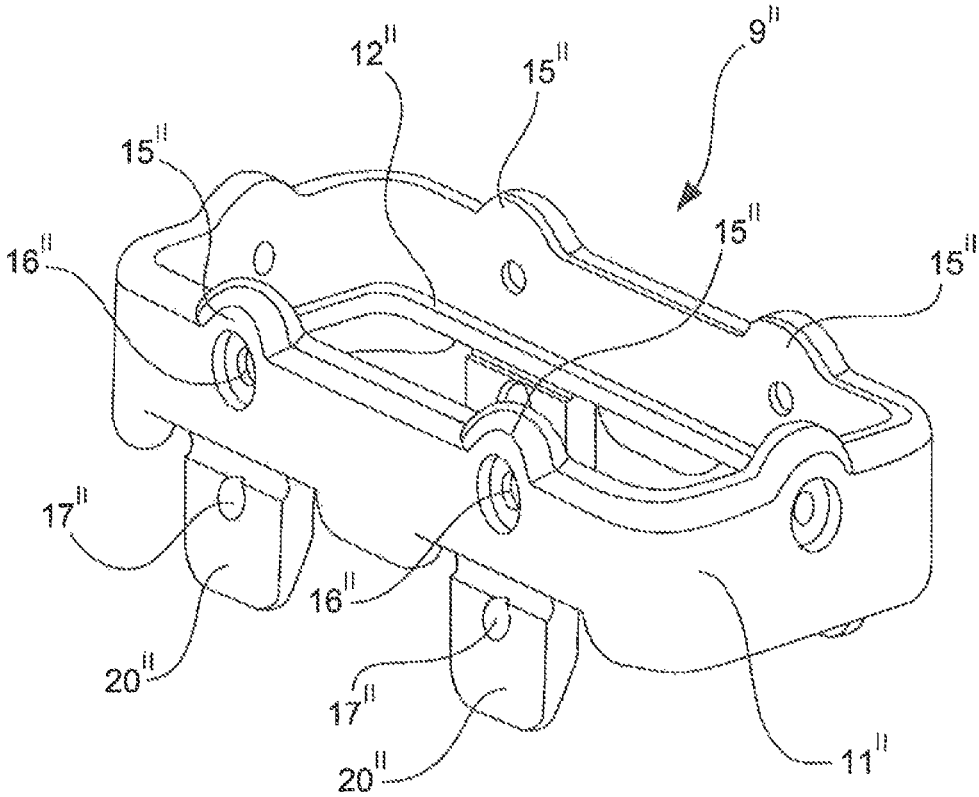

One exemplary embodiment is illustrated in the drawings and explained in more detail below. In the figures:

FIG. 1 shows a perspective representation of a counter connector housing interlocked with a plug-and-socket connector housing, FIG. 2 shows a perspective representation of a locking device, FIG. 3 shows a perspective representation of a plug-and-socket connector housing and counter connector housing, which are linked with each other by means of a second embodiment of the locking device, FIG. 4 shows a perspective representation of the second embodiment of the locking device and FIG. 5 shows a perspective representation of a third embodiment of the locking device.

FIG. 1 shows a perspective representation of a counter connector housing 2 interlocked with a plug-and-socket connector housing 1. The plug-and-socket connector housing 1 and counter connector housing 2 are components that have been available on the market for many years. Herein, the plug-and-socket connector housing 1 and counter connector housing 2 have an identical structural design. Yet, this is not always the case. The plug-and-socket connector housing 1 comprises an opening 3 through which the cable to be connected (not illustrated herein) extends into the inside of the plug-and-socket connector housing 1. Support pegs 18 are formed onto the long sides of the plug-and-socket connector housing 1.

FIG. 2 shows a perspective representation of the locking device 9. The locking device 9 has an essentially rectangular main body 11. A circumferential web 12 is provided within the main body 11, said web correlating with the edge of the plug-and-socket connector 1 housing. The web 12 is present on both sides of the main body 11. This helps seal two plug-and-socket connector housings 1, 2 (connector and counter connector housing) interlocked with each other against media such as for example dust and water. The main body 11 is also known as locking ring.

Locking arms 15, 20 are sticking out vertically from the main body 11 of the locking device 9 in both directions. Together, the individual locking arms 15, 20 sticking out in an opposite direction form a pair of locking arms 10. Each of the locking arms 15, 20 comprises holders 16, 17 that encompass the support pegs 18 of the housings 1, 2.

The difference in height between the holders 16, 17 of the locking arms 15, 20 and the level of the circumferential web 12 is lower than the difference in height between the support pegs 18 and the lower edge of the plug-and-socket connector housing 1 resting on the web 12. Because the locking arms 15, 20 are made of an elastic material (an elastomer), the tensile force is exerted onto the support pegs 18 in an axial direction and the lower edge of the plug-and-socket connector housing 1 is pushed onto the Web 12. As a result, the locking device at the same time achieves an optimal sealing function.

The locking arms 15, 20 are provided with a sloping edge 13 on the inside. Therefore, the locking arms are not abutting directly on the plug-and-socket connector housing 1 and the counter connector housing 2 in the top area. As a result, the locking arms 15, 20 can easily be removed again manually from the support peg 18. During the locking procedure, the sloping edge 13 initially helps the locking arms 15, 20 glide across the housing edge and the support pegs 18. Next, the locking arms 15, 20 are folded over the support pegs 18 such that the support pegs 18 are positioned in the appropriate holders 16, 17. Only a minor expenditure of force is required for said type of locking procedure.

If the tensile force of the elastomeric locking arms 15, 20 decreases, a customer can continue using the plug-and-socket connector housings 1, 2 and simply mount a new, fresh locking device 9. Subject to the appropriate selection of materials, the locking device 9 according to the invention can be provided as a recyclable disposable part. Thus, the sealing and locking effect always remains on the same level when the housings 1, 2 are re-connected.

FIG. 3 shows an additional embodiment of a locking device 9' according to the invention. Components with identical function are labeled with the same reference numbers already used above. However, to emphasize a difference between the individual embodiments, a "'" sign is added to the reference numbers.

The locking arms 15' of the locking device 9' are fastened on the plug-and-socket connector housing 1 by means of rivets 4. However, a screwed connection can be provided instead of rivets. The locking arm 20' is designed as one piece and contains two holders 17', which overlap the pegs 18 of the counter connector housing 2.

Housings are available on the market, which are equipped with pegs 18 on the long side or also on the narrow side. For counter connector housings 2 with pegs 18 on the narrow sides, the locking arm 20' is mounted on the narrow side of the main body 11' of the locking device 9'. If the pegs are on the long side of the plug-and-socket connector housing 1, the locking arms 15', 20' can stick out from the main body 11' of the locking device 9' at different positions (long side, narrow side). This means that it is possible to interlock housings 1, 2 whose pegs 18 are oriented differently toward each other with the locking device 9' according to the invention. In the past, this was not possible with the known locking devices.

FIG. 5 shows a perspective representation of a third embodiment of the locking device 9". In this embodiment, the locking arms 15" are again preferably mounted on the plug-and-socket connector housing 1 by way of a riveted or screwed connection.

As previously described for the other embodiments, the locking arms 20" are guided across the support pegs 18 of the counter connector housing 2, thus interlocking the housings 1, 2 with each other. With said embodiment, the locking arms 15", 20" can again be mounted on the main body 11" such that different housing types with different support peg positions can be interlocked with each other. Said property renders the locking devices 9, 9', 9" flexible and universally usable.

REFERENCE LIST

Locking Device for a Plug-and-Socket Connector Housing
1 Plug-and-socket connector housing
2 Counter connector housing
3 Opening for the outgoing cable
4 Rivet
9 Locking device
10 Pair of locking arms
11 Main body, locking ring
12 Circumferential web
13 Sloped edge
15 Individual locking arm
16 Holder
17 Holder
18 Support peg
20 Individual locking arm

The invention claimed is:

1. A locking device for reversibly locking a plug-and-socket connector housing to a counter connector housing, at least one of the plug-and-socket and counter connection housings having a support peg for reversible attachment to the locking device, wherein said locking device comprises, a main body defining an enclosed perimeter for surrounding a juncture between the plug-and-socket and counter connector housings, a pair of locking arms extending in vertically opposite directions from said main body, one of said pair of locking arms including a first substantially vertical wall having a first holder for receiving the support peg for reversible engagement therewith, said one of said pair of locking arms further including a sloping edge wall extending from said first wall and sloping outwardly in a direction away from the plug-and-socket and counter connector housings, and a second substantially vertical wall extending from said sloping edge wall to a free end, said second wall arranged to be in non-abutting relationship with said housings for manually removing the locking device from the support peg, said other of said pair of locking arms including a second holder for attachment to the other of said plug-and-socket and counter connector housings, and wherein at least one of said locking arms is made of elastomeric material.

2. A locking device according to claim 1, wherein a sealing element to prevent the infiltration of media is an integral part of the locking device.

3. A locking device according to claim 1, wherein the elastomeric material has a Shore B hardness between 90 and 30.

4. A locking device according to claim 1, wherein the elastomeric material has a Shore A hardness between 90 and 30.

5. The locking device of claim 1, wherein said first holder is a bore hole for receiving the support peg.

6. A locking device according to claim 5, wherein said first holder is reinforced with a plastic component.

7. A plug-and-socket connector housing which is irreversibly linked with a locking device (9, 9', 9") according to claim 1.

8. The locking device of claim 1, wherein said second holder is fixedly and irreversibly attached to the other of said plug-and-socket and counter connector housings.

9. The locking device of claim 8, wherein said second holder is an opening through which a rivet or screw is received for fixedly and irreversible attachment to the other of said plug-and-socket and counter connector housings.

10. A locking device according to claim 5, wherein said first holder is reinforced with a metal component.

11. The locking device of claim 1, wherein said second holder is a bore hole for receiving a support peg from one of said plug-and-socket and counter connector housings.

12. A locking device for reversibly locking a plug-and-socket connector housing to a counter connector housing, said plug-and-socket connector housing including a side wall with at least one support peg extending outwardly therefrom, said plug-and-socket connector housing having a free edge, said locking device comprising a main body defining an enclosed perimeter for surrounding the free edge of the plug-and-socket connector housing when connected therewith, said main body including a circumferential web for receiving the free edge of said plug-and-socket connector housing, said main body including a locking arm of elastomeric material and having at least one bore hole therewithin for receiving the at least one support peg, wherein the distance between the bore hole and the circumferential web of the main body is less than the distance between the support peg and the free end of the plug-and-socket connector housing, so that a tensile force is exerted to push the plug-and-socket connector housing into the web when the plug-and-socket connector housing is attached to the locking device.

13. The locking device of claim 12, wherein said main body is attached to a counter connector housing.

* * * * *